United States Patent [19]

Farkas et al.

[11] Patent Number: 5,057,673

[45] Date of Patent: Oct. 15, 1991

[54] SELF-CURRENT-LIMITING DEVICES AND METHOD OF MAKING SAME

[75] Inventors: Richard W. Farkas, Stow; David A. Rock; Louis A. Miller, both of Ravenna; Eric G. Hilston, Kent, all of Ohio

[73] Assignee: Fluorocarbon Company, Aurora, Ohio

[21] Appl. No.: 196,146

[22] Filed: May 19, 1988

[51] Int. Cl.[5] ..... H05B 3/00

[52] U.S. Cl. ..... 219/549; 29/611

[58] Field of Search ..... 219/549, 548, 504, 505; 338/214; 29/610.1, 611

[56] References Cited

U.S. PATENT DOCUMENTS

| | | | |
|---|---|---|---|
| 3,243,753 | 3/1966 | Kohler | 338/31 |
| 3,673,121 | 6/1972 | Meyer | 252/511 |
| 3,733,385 | 5/1973 | Reddish | 264/105 |
| 3,793,716 | 2/1974 | Smith-Johannsen | 252/511 |
| 3,823,217 | 7/1974 | Kampe | 264/105 |
| 3,858,144 | 12/1974 | Bedard et al. | 338/22 R |
| 3,861,029 | 1/1975 | Smith-Johannsen et al. | 338/214 |
| 3,862,056 | 1/1975 | Hartman | 252/511 |
| 3,914,363 | 10/1975 | Bedard et al. | 264/105 |
| 4,055,526 | 10/1977 | Kiyokawa et al. | 219/548 |
| 4,200,973 | 5/1980 | Farkas | 219/549 |
| 4,271,350 | 6/1981 | Crowley | 219/549 |
| 4,277,673 | 7/1981 | Kelly | 219/528 |
| 4,286,376 | 9/1981 | Smith-Johannsen et al. | 338/214 |
| 4,309,596 | 1/1982 | Crowley | 219/549 |
| 4,309,597 | 1/1982 | Crowley | 219/549 |
| 4,327,480 | 5/1982 | Kelly | 219/528 |
| 4,330,493 | 5/1982 | Miyamoto et al. | 338/214 |
| 4,334,351 | 6/1982 | Sopory | 338/20 |
| 4,388,607 | 6/1983 | Toy | 219/549 |
| 4,426,339 | 1/1984 | Kamath et al. | 264/22 |
| 4,471,215 | 9/1984 | Blumer | 219/549 |
| 4,724,417 | 2/1988 | Au et al. | 219/549 |
| 4,907,340 | 3/1990 | Fang et al. | 29/610.1 |
| 4,951,384 | 8/1990 | Jacobs et al. | 29/611 |

*Primary Examiner*—Geoffrey S. Evans

*Attorney, Agent, or Firm*—Fay, Sharpe, Beall, Fagan, Minnich & McKee

[57] ABSTRACT

A self-current-limiting device and a method of making self-current-limiting devices. These devices typically comprise melt processable, self-temperature regulating, irradiation cross-linked, electrically semi-conductive polymeric compositions having positive temperature coefficients of electrical resistance. The semi-conductive compositions contain electrically conductive particles, such as carbon black, dispersed throughout the composition in an amount ranging from about 15% to about 20% of the total weight of the composition. Heating cables made in accordance with the invention comprise two or more elongate substantially parallel spaced-apart electrical conductors that are electrically inter-connected by extruded forms of the compositions. The method is characterized by an efficient three step process wherein the semi-conductive composition is extruded over the conductors, radiation cross-linked and annealed. The method of the invention does not require the application of a shape retaining jacket to the cable prior to annealing. Additionally, only one annealing step is utilized.

9 Claims, 3 Drawing Sheets

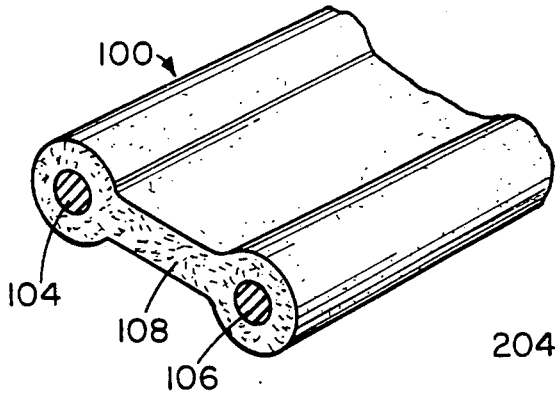
FIG. 1
FIG. 3
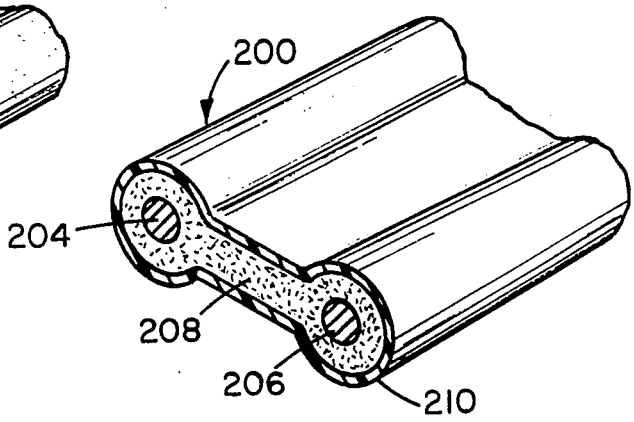
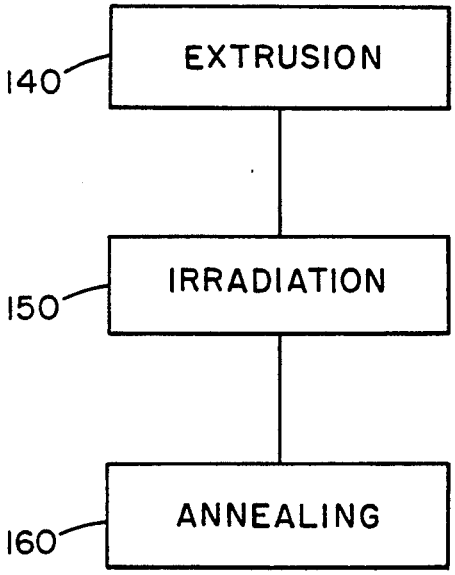
FIG. 2
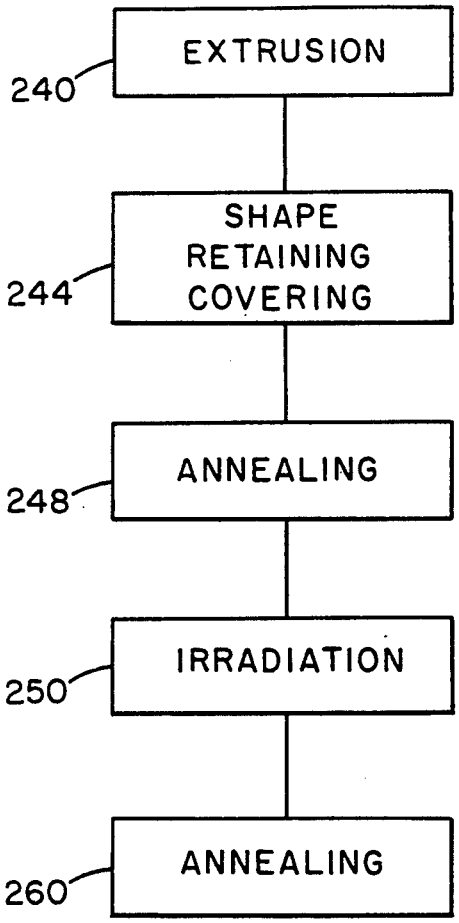
(PRIOR ART)
FIG. 4

TEMPERATURE-RESISTANCE RELATION, "SAMPLE B" HEATER

TEMPERATURE-RESISTANCE RELATION, "SAMPLE A" HEATER

SELF-CURRENT-LIMITING DEVICES AND METHOD OF MAKING SAME

FIELD OF THE INVENTION

The invention relates generally to self-current-limiting devices and a method of making the devices. Specifically, the invention is directed to improved devices and methods related to melt processable, self-temperature regulating, irradiation cross-linked, electrically semi-conductive polymeric compositions and heating cables.

BACKGROUND OF THE INVENTION

Self-regulating electrically semi-conductive compositions, in the form of extruded flexible electrical heating cables, are often used in resistive heating applications. For example, heating cables incorporating these compositions may be used for freeze protection of pipes and for maintenance of flow characteristics of viscous fluids in pipes and storage containers. Self-regulating semi-conductive compositions may also be found in applications not involving resistive heating, for example, heat sensing and circuit-breaking.

In resistive heating applications, it is desirable for the self-regulating electrically semi-conductive composition to have a positive temperature coefficient of electrical resistance. A material exhibits a positive temperature coefficient of electrical resistance when the electrical resistance of the material increases as the temperature of the material increases. The increase in temperature may result from either a rise in the ambient temperature surrounding the composition or by reason of resistive heating caused by the passage of electrical current through the composition. One popular class of self-regulating compositions which exhibit positive temperature coefficients of resistance are thermoplastic compositions comprising electrically conductive particles, such as carbon black, dispersed throughout a polymeric base. The resulting composition may be viewed as a polymeric matrix foundation within which is located an interconnected array of conductive channels formed from the carbon particles.

It has been theorized that the positive temperature coefficient of electrical resistance of these compositions is caused by the expansion of the polymeric matrix at a rate which is greater than the rate of expansion of the conductive channels. The expansion of the polymeric matrix causes an increase, or other alteration, of the spacial relationship between the electrically conductive particles in a manner which causes the electrical resistance of the polymeric composition to increase. This increase in the electrical resistance (R) of the polymeric composition, for a fixed electrical potential (V) placed across the composition, causes the electrical current (I) passing through the composition to be reduced. Thus, the amount of heat generated by the passage of the electrical current through the resistive composition, given by the relationship that heat equals $I^2R$ (or equivalently $V^2/R$), is also reduced. Conversely, a decrease in the temperature of the matrix causes the matrix to contract which places the conductive particles or channels in closer proximity to one another. This reduced spacing between conductive channels decreases the electrical resistance (R) of the polymeric composition which in turn causes the electrical current (I) to increase with a corresponding increase in heat generation.

An alternate theory, which does not depend on the expansion and contraction of the polymeric composition, explains the positive temperature coefficient of electrical resistance in terms of the amount of crystallinity present in the polymeric composition. According to this theory, the increase in the electrical resistance of the composition as the temperature of the composition increases may arise as a result of the reorientation of the crystalline-amorphic boundaries within the polymeric composition. This reorientation of the boundaries tends to electrically insulate the conductive particles (or groups of electrically conductive particles) from each other. The more effective insulation of the individual conductive components of the composition on the microscopic level contributes to the increase in the electrical resistance of the composition on the macroscopic level.

Additional information on the general theory of how self-limiting devices work may be found in U.S. Pat. No. 4,200,973 entitled "METHOD OF MAKING SELF-TEMPERATURE REGULATING ELECTRICAL HEATING CABLE" issued to Farkas; U.S. Pat. No. 3,914,363 entitled "METHOD OF FORMING SELF-LIMITING CONDUCTIVE EXTRUDATES" issued to Bedard et al.; and U.S. Pat. No. 3,823,217 entitled "RESISTIVITY VARIANCE REDUCTION" issued to Kampe.

Methods of making self-regulating positive temperature coefficient polymeric compositions generally comprise a variety of steps. The method steps often include: extruding the compositions; applying shape retaining jackets to the compositions; annealing the compositions at or above their melt point temperatures; and cross-linking the polymeric components with radiation. These steps, in a variety of combinations, are typical of procedures used in the production of self-regulating semi-conductive polymeric compositions containing amounts of carbon black ranging from less than about 10% to greater than about 75% of the total weight of the composition.

Electrically conductive polymeric compositions that contain greater than about 25%, by volume, of carbon black, have been described as having positive temperature coefficients of resistance and ar suggested for use as self-regulating heaters. An example of such compositions can be found in Kohler's U.S. Pat. No. 3,243,753 entitled "RESISTANCE ELEMENT" wherein the electrically semi-conductive compositions are described as containing 25 to 75 percent by volume carbon black as a result of in-situ polymerization. The method described therein results in a matrix of finely divided carbon particles embedded within a thermoplastic material. This is achieved by subjecting a mixture of the thermoplastic material and the carbon particles to elevated temperatures and pressures so that in-situ polymerization of the thermoplastic material occurs. Although such compounds may be useful for some heating purposes, it has been found that polymeric compositions containing more than about 25% by weight of carbon black generally possess poor cold temperature properties; exhibit inferior elongation characteristics; and generally do not possess good electrical current regulating characteristics in response to changes in temperature.

It has also been proposed that electrically semi-conductive compositions must not have more than 15% by weight of carbon black in order to provide a useful self-regulating heating device. Such teaching can be found, for example, in U.S. Pat. No. 3,793,716 entitled "METHOD OF MAKING SELF LIMITING HEAT ELEMENTS", issued to Smith-Johannsen. Described therein is a process for making a self-regulating heating element comprising polyethylene and less than 15% by weight of carbon black. This composition is manufactured by casting the semi-conducting composition from a solution or fusing a powder.

In U.S. Pat. No. 3,861,029 entitled "METHOD OF MAKING HEATER CABLE" issued to Smith-Johannsen, a polymeric material containing not more than about 15% by weight of carbon black is subjected to a prolonged annealing procedure at or above the melting temperature of the polymeric material. Articles produced in this manner exhibit electrical volume resistivities at room temperature in the range of from about 5 to 100,000 ohm-cm.

A further example of low carbon black content materials can be found in U S. Pat. No. 3,914,363 entitled "METHOD OF FORMING SELF-LIMITING CONDUCTIVE EXTRUDATES" issued to Bedard. This reference describes a method wherein a shape-retaining thermal plastic jacket is disposed about a self-regulating conductive article comprising crystalline polymeric compositions containing not more than about 15% by weight of conductive carbon black. The jacketed article is annealed at a temperature at or above the crystalline melting point of the composition, its shape being maintained by the jacket during the annealing process. The annealing procedure reduces the room temperature electrical volume resistivity of the polymeric composition to within the range of from about 5 to about 100,000 ohm-cm. Similarly, U.S. Pat. No. 3,858,144 entitled "VOLTAGE STRESS-RESISTANT CONDUCTIVE ARTICLES" issued to Bedard describes a method of making carbon black containing resistive heaters which are self regulating. The method disclosed comprises extruding a carbon black containing matrix preferably having less than 15% carbon black onto spaced apart electrodes; covering the extruded article with a shape-retaining jacket; annealing the article at a temperature at or above the melting point of the polymeric matrix; and radiation cross-linking the matrix to achieve thermal stability. Additionally, U.S. Pat. No. 4,277,673 entitled "ELECTRICALLY CONDUCTIVE SELF-REGULATING ARTICLE" and U.S. Pat. No. 4,327,480 entitled "ELECTRICALLY CONDUCTIVE COMPOSITION, PROCESS FOR MAKING AN ARTICLE USING SAME" both issued to Kelly, describe methods for making self-regulating compositions comprising extruding a polymeric composition; covering the extruded article with shape retaining jacket; annealing or thermal structuring of the material; and radiation cross-linking.

A method for increasing the stability of a device comprising at least one electrode and a conductive polymer is described in U.S. Pat. No. 4,426,339 entitled "METHOD OF MAKING ELECTRICAL DEVICES COMPRISING CONDUCTIVE POLYMER COMPOSITIONS" issued to Kamath. In this method, a composition containing about 15% to 17% carbon black is hot extruded onto a heated conductor to improve the contact between the conductor and the composition; the article is then annealed to decrease the resistivity of the composition; and either chemically cross-linked simultaneously with the extrusion and annealing or subsequently radiation cross-linked as a separate step after the extruding and annealing steps.

U.S. Pat. No. 3,823,217 entitled "RESISTIVITY VARIANCE REDUCTION" issued to Kampe describes a cyclic annealing process. Self-temperature regulating articles which contain carbon black dispersed therein in an amount not greater than about 15% by weight to the total weight of the composition are exposed to successive thermal cycles. During each cycle, the article is brought to a temperature which is at or above the melting temperature of the crystalline polymeric matrix in which the carbon black is dispersed. This process is used to reduce the electrical volume resistivity of the article to a value within the range of from about 5 to about 100,000 ohm-cm at 70° F. for the low carbon black content compositions disclosed therein.

As described in Farkas, U.S. Pat. No. 4,200,973, a method of making a self-regulating heater using polymeric compounds containing from 17% to 25% carbon black comprises the following steps: a) extruding the composition around at least two substantially parallel spaced apart electrodes; b) placing a radiation penetrable shape retaining covering around the extruded composition and conductors; c) annealing the covered composition at a temperature that is at least at the melt point of the composition; d) cross-linking the annealed composition with radiation; and e) annealing the radiation cross-linked composition at a temperature which is at least at the melt point of the composition. Compositions produced by this method exhibit a positive temperature coefficient of electrical resistance. When combined with two or more spaced apart electrical conductors, these compositions provide a flexible, self-temperature regulating electrical heating cable having good current limiting properties and good physical properties. After the extrusion step a), the low carbon black content composition has an electrical resistance which is much too high for practical use as a heating device. The first anneal step c) reduces this resistance to a usable level. Since the first annealing step c) is at least at the melt point temperature of the composition, it is necessary to apply the shape retaining covering over the cable prior to the annealing process to prevent the heating cables from losing their shape during the annealing process. Therefore, the shape retaining covering must be capable of maintaining its shape at temperatures above the annealing temperature. After the first anneal step c), the composition still exhibits poor current-limiting features as well as poor physical properties. The current-limiting and physical properties of the composition are improved by the subsequent irradiation cross-linking step d) and the post irradiation annealing step e).

In this method and other methods which require annealing at or above the melt point temperature of the composition to reduce the resistance of the heater after it has been extruded, a non-melting shape-retaining jacket may be used to prevent the semi-conductive composition from deforming during annealing. This is necessary since the annealing is performed at a temperature at or above the melting point of the composition.

The application of the shape-retaining jacket and the selection of the material comprising the jacket are often difficult and limiting steps in these methods of producing self-regulating heater cables. Accordingly, it is desirable to eliminate the step requiring the application of the shape-retaining jacket while maintaining the other advantageous characteristics of a heater cable using a semi-conductive composition comprising carbon black in a range of from about 15% to about 25%. Additionally, it is desirable to reduce the number of annealing steps, since annealing is an expensive and time consuming process.

SUMMARY OF THE INVENTION

The present invention is directed to a self-current-limiting device and a method for making self-current-limiting devices. In one embodiment, the invention comprises a melt processable, radiation cross-linkable, electrically semi-conductive composition having a positive temperature coefficient of electrical resistance. The semi-conductive composition is adapted for use in a self-regulating electrical heating article and comprises at least one polymeric component having sufficient crystallinity to promote the self-regulating conductive characteristics of the composition. An amount of electrically conductive particles, within the range of about 15 percent to about 20 percent by weight to the total weight of the composition, is dispersed throughout the polymeric composition. The semi-conductive composition has a first range of electrical resistances which vary with the temperature of the composition after the composition is first formed into a desired shape by extruding or other means. After being irradiated to cross-link; said polymeric components and then being subsequently annealed at an annealing temperature for an annealing time period, the composition has a .second range of electrical resistances which vary with the temperature of the cross-linked and annealed composition. The resistance values comprising the second range of resistances are generally greater than the resistance values comprising the first range of resistances.

The invention further comprises a method of forming a self-regulating conductive article comprising at least two spaced-apart electrical conductors electrically interconnected by means of an extruded, cross-linked, electrically semi-conductive composition having a positive temperature coefficient of electrical resistance. The composition contains at least one polymeric component therein to provide sufficient crystallinity to promote the self-regulating conductive characteristics thereof and further contains an amount of electrically conductive particles dispersed therein that is controlled within the range of 15 percent to 20 percent by weight to the total weight of the composition. The method includes the steps of: 1) forming the cross-linkable, electrically semi-conductive composition about the spaced-apart electrical conductors in such a manner that the composition electrically interconnects the spaced apart conductors; 2) irradiating the formed composition to cross-link the polymeric component therein; and 3) annealing the cross-linked semi-conductive composition at an annealing temperature for an annealing time period sufficient to promote the electrical characteristics desired in the final device. The method advantageously allows for the annealing of the device without first placing a protective jacket around the device as is required by many prior art methods. However, a protective jacket may still be placed around the finished device for electrical insulation and/or physical protection of the semi-conductive composition.

Another embodiment of the invention comprises a self-regulating heating cable comprising at least two spaced apart electrical conductors. The conductors are electrically inter-connected by a melt processable, radiation cross-linkable, electrically semi-conductive composition having a positive temperature coefficient of electrical resistance. The semi-conductive composition comprises an amount of electrically conductive particles dispersed throughout the composition, wherein the amount of the conductive particles is controlled within the range of about 15 percent to about 20 percent by weight to the total weight of the composition. After forming, the semi-conductive composition has a first range of electrical resistances which vary with the temperature of the composition. The composition, after being irradiated to cross-link the polymeric components and then being subsequently annealed at an annealing temperature for an annealing time period to change the electrical characteristics of the composition, has a second range of electrical resistances which vary with the temperature of the extruded, cross-linked and annealed composition. The resistance values comprising the second range of resistances are generally greater than the resistance values comprising the first range of resistances.

These and other characteristics of the present invention will become apparent through reference to the accompanying drawings.

BRIEF DESCRIPTION OF THE DRAWINGS

FIG. 1 shows a fragmented perspective view of an embodiment of the invention having a bar-bell type transverse cross-section and having two elongate substantially parallel spaced-apart electrical conductors of the same general configuration.

FIG. 2 is a block diagram showing an improved method by which self-regulating positive temperature coefficient materials may be produced in accordance with the present invention.

FIG. 3 shows a fragmented perspective view of an embodiment of the invention having a bar-bell type transverse cross-section, two elongate substantially parallel spaced-apart electrical conductors of the same general configuration and a protective jacket disposed in encompassing relationship about the entire assembly.

FIG. 4 is a block diagram showing an alternate method for making self-regulating positive temperature coefficient materials and described in detail in U.S. Pat. No. 4,200,973 entitled "METHOD OF MAKING SELF-TEMPERATURE REGULATING ELECTRICAL HEATING CABLE", the disclosure of said patent hereby incorporated herein by reference.

DETAILED DESCRIPTION OF THE PREFERRED EMBODIMENT

Figure 5:
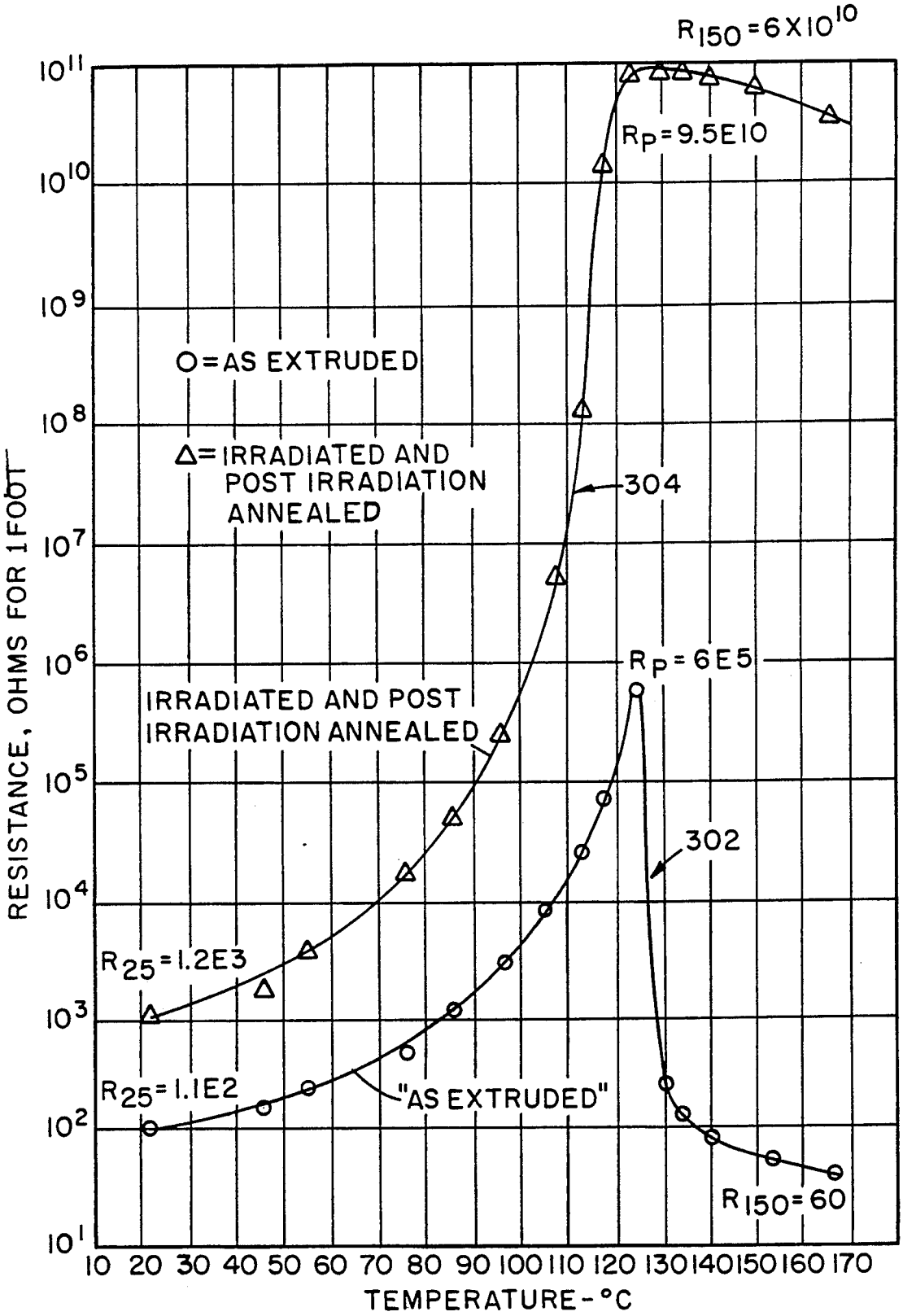
FIG. 5 is a graph of the electrical characteristics of a self-regulating positive temperature coefficient material made in accordance with the present invention and the method illustrated in FIG. 2.

FIG. 1 illustrates an embodiment of the invention in the form of a heating cable 100 having a generally bar-bell shaped transverse cross-section. The cable 100 comprises a pair of elongate substantially parallel conductors 104 and 106 which are spaced apart along the longitudinal length of the cable 100. The conductors 104 and 106 are electrically interconnected by means of an extruded and irradiation cross-linked semi-conductive composition 108 made and processed in accordance with the invention.

Preferred materials for the conductors 104 and 106 are suitable alloys of copper or aluminum having low electrical resistance. However, other materials such as nickel-chromium alloys commonly known as Nichrome may be used. The conductors are typically uncoated or conductively coated solid or stranded wire preferably ranging in size range from about 10 AWG to about 22 AWG. While the conductors 104, 106 shown in FIG. 1 are rod shaped, it will be understood that the conductors may have any cross-sectional shape suitable for the intended application of a particular heating cable.

It is preferred that the conductors be made from metallic materials, however, they may be made from non-metallic materials or from combinations of metallic and non-metallic materials. Regardless of the material from which the conductors are made, it is desirable that the electrical resistance of the conductors 104, 106 be lower than the electrical resistance of the composition 108. This enables the conductor to provide sufficient electrical current carrying capacity along the axial length of the cable 100 for the efficient operation of a heating cable incorporating the semi-conductive composition 108.

Semi-conductive composition 108 is disposed between conductor 104 and conductor 106 and provides an electrical interconnection therebetween. In one embodiment, the composition 108 is an extruded, flexible, self-regulating, irradiation cross-linked, positive temperature coefficient of electrical resistance, semi-conductive material. One material which is known to have all of these characteristics comprises one or more polymeric components within which is dispersed a controlled amount of electrically conductive particles.

It is preferred that the electrically-conductive component of compositions 108 comprise carbon particles such as carbon black or graphite. One such commercially available carbon black material is a highly electrically-conductive furnace black called Vulcan XC-72, which is sold by the Cabot Corporation. However, the conductive component may also be metallic in nature such as, for example, silver, aluminum, iron, or the like. In one embodiment, it is preferred that the amount of electrically-conductive carbon particles present in the composition be controlled within the range of from about 15% to about 20% by weight to the total weight of the composition.

The polymeric components of the semi-conductive composition 108 include homopolymers or copolymers of crystalline materials such as, for example, polyethylene, polypropylene, and blends thereof. Generally, the semi-conductive composition 108 contains one or more melt-processable crystalline and/or semi-crystalline polymeric materials which may be combined with suitably selected amorphous and/or elastomeric polymeric materials provided that the completed compositions remain melt-processable. Additionally, the crystalline properties of the particular polymer or combination of polymers used in making the semi-conductive composition often determines the controlling temperature about which the composition will self-temperature regulate. It is desirable that the melt-processable composition provide a controlling temperature, after being processed in accordance with the method of the present invention, that is satisfactorily beneath the long term heat exposure degradation level of the composition. In one embodiment of the present invention, the crystalline melt-processable components of the semi-conductive composition 108 include ethylene vinyl acetate and a copolymer or blend of high density polyethylene. One commercially available ethylene vinyl acetate is Du Pont's Elvax-460. One commercially available high density polyethylene is Union Carbide's DGDJ 3364. Both of these materials have been used to practice the invention. It will be understood, however, that other comparable materials may also be used to practice the invention.

Additives such as fillers, anti-oxidants, heat stabilizers, processing aids, and the like, may be included in the semi-conductive composition to provide the physical, chemical, heat resistance, and self-temperature regulating characteristics desired in the final product. It is desirable to maintain the melt-processable and radiation cross-linkable properties of the composition when including additives. Some of the ingredients commonly added to polymeric compounds include: 1) ethylene copolymers like ethylene-vinyl acetate, ethylene-ethyl acrylate, ethylene-methyl acrylate, ethylene-acrylic acid, ethylene-methacrylic acid, etc.; 2) fillers such as calcium carbonate, aluminum oxide, zinc oxide, titanium oxide, etc.; and 3) any of the anti-oxidants or other anti-degradation agents commonly used in polymeric compounds.

The flexibility of the semi-conductive compositions is dependent upon the properties of the constituents of the composition including: the crystallinity and other properties of the polymers, the type and amount of electrically-conductive particles and the amounts and properties of other additives. Thus, compositions made in accordance with the invention may range from relatively rigid versions having melt-processing characteristics more suitable for injection molding to more flexible versions having melt-processing characteristics more suitable to the process of extrusion. The melt-processing characteristics of a particular composition can generally be determined by means of experimentation and examination of the rheological aspects of the particular composition.

One method by which the heating cable 100 may be made is illustrated by the block diagrams shown in FIG. 2. The method comprises an extrusion step 140 wherein a mixture of the polymeric components and conducting particles is extruded around the conductors 104 and 106, an irradiation step 150 wherein the composition 108 is exposed to radiation to cause the polymers in the material to cross-link, and an annealing step 160 wherein the extruded, cross-linked material is heated to a temperature and held at that temperature for a time duration sufficient to promote the desired electrical and physical characteristics of the finished heating cable.

Prior to extruding the material in step 140, the hereinbefore described polymeric components, conductive particles and additives comprising the composition 108 are uniformly mixed and blended using normal polymer mixing techniques. One such device commonly used for this process is a Banbury mixer. Although it is preferred that the components be mixed and blended in conjunction with sufficient heat to promote uniform distribution of the conductive particles, it is also possible with some compositions to dry blend the ingredients. In general, any mixing and blending technique which uniformly disperses the conductive particles throughout the polymeric materials may be used.

In making electrical heating cables utilizing the method of the present invention, it is preferred that the compositions be extruded as represented by step 140 in FIG. 2. Extrusion provides economic savings and other advantages associated with the capability of producing long continuous lengths of material. It will be understood however, that other methods of forming the compositions about the conductors, such as casting, may also be used.

After mixing the ingredients of the self-regulating composition and extruding the composition about the conductors to form a semi-finished heating cable, the composition is subjected to ionizing radiation sufficient in strength to cross-link the polymeric matrix containing the carbon black. The cross-linking by irradiation is represented by step 150 in FIG. 2. Preferably, the cross-linking is performed by exposing the composition to ionizing radiation produced by accelerate electrons. The radiation dosage is selected with an eye toward achieving cross-linking sufficient to impart a degree of thermal stability requisite to the particularly intended application without unduly diminishing the crystallinity of the polymeric matrix. Within these guidelines, the radiation dosage may in particular cases range from about 2 megarads to about 35 megarads or more.

Although any suitable means of producing the radiation may be used for cross-linking the compositions of the invention, radiation generated by high speed electrons, for example, as produced by an electron beam accelerator, is commonly used for this purpose. Other components used in making electrical heating devices in combination with the semi-conductive compositions of the invention (such as, for example, an outer protective jacket for covering the heating cable) may also be cross-linked by irradiation. The irradiation cross-linkability of compositions of the invention may be improved by the incorporation within the composition of radiation sensitizing additives such as, for example, m-phenylene dimaleimide sold under the name of "HVA-2" by E.I. du Pont de Nemours & Company.

The extruded and cross-linked semi-finished heater cable is annealed in step 160 at a temperature that is at or above the melt point temperature of the composition for a period of time sufficient to effect the electrical characteristics desired. Typical annealing temperatures are in the range of from approximately 140° C. to approximately 250° C. The composition is heated to the required annealing temperature and held at that temperature for a time period ranging from a few minutes to in excess of 48 hours, depending upon the particular composition being annealed.

FIG. 3 illustrates an embodiment of the invention wherein a heating cable 200 has a generally bar-bell shaped transverse cross-section The cable 200 comprises a pair of elongate substantially parallel conductors 204 and 206 in the form of rod shaped wires which are spaced apart along the longitudinal length of the cable 200. The conductors 204 and 206 are electrically interconnected by means of an extruded and irradiation cross-linked positive temperature coefficient composition 208 made and processed in accordance with the invention. The entire assembly comprising the conductors 204 and 206 and the composition 208 is surrounded by an outer protective jacket 210.

The conductors 204 and 206 are as previously described in reference to conductors 104 and 106. The composition 208 may be made in accordance with the present invention or by means of other techniques, such as the one described in U.S. Pat. No. 4,200,973.

The jacket 210 is disposed in encompassing relationship about the conductors 204 and 208 and positive temperature coefficient material 208 to provide protection and electrical insulation for the cable. Although the jacket 210 may be made from any suitable material possessing the electrically insulative and protective properties required, it is preferred that the jacket be made from an extrudable polymeric material such as, for example, nylon, polyurethane, polyvinyl chloride, rubber, rubber-like elastomers, and the like possessing such properties. The selection of a material for use in the jacket is typically based upon a combination characteristics including toughness, weatherability, chemical and heat resistance, electrical insulating ability and flexibility. The jacket 210 may be extruded about the cable or may be in the form of a winding. In the case of a winding, the jacket may be either spirally wound about the cable or longitudinally folded about cable and bonded thereto by suitable means. Although not shown in FIG. 3, flexible armor or other protective means may be disposed about the jacket 210 to provide increased protection, if such is desired. If methods other than that of the present invention are used to make the composition 208, such as, for example, the method disclosed in U.S. Pat. No. 4,200,973, the jacket 210 may serve the additional function of retaining the shape of the heater 200 during initial thermal structuring or annealing processes.

FIG. 4 illustrates by means of block diagrams the basic steps of the process by which flexible heating cables utilizing extruded compositions are made according to the disclosure of the 4,200,973 patent. This method comprises: 1) extrusion step 240 wherein a mixture of the polymeric components and conducting particles is extruded around the conductors 204 and 206; 2) a step 244 for applying a shape retaining jacket to the extruded cable; 3) an annealing or thermal structuring step 248 for alteration of the electrical characteristics of the composition 208; 4) an irradiation step 250 wherein the composition 208 is exposed to ionizing radiation to cause the polymers in the material to cross-link; and 5) an annealing step 260 wherein the extruded, cross-linked composition is heated to an annealing temperature and held at that temperature for a time duration sufficient to promote the desired electrical and physical characteristics of the finished heating cable.

Generally, the extrusion step 240 is preceded by uniformly mixing and blending the hereinbefore described polymeric components, conductive particles and additives, if any. The mixing and blending is achieved by suitable means such as, for example, a Brabender batch type mixer, a Henschel continuous type mixer/extruder and the like. It is preferred that the components of the composition 208 be mixed and blended in conjunction with sufficient heat to promote uniform distribution of the conductive particles within the composition. However, dependent upon the particular compositions being used, uniform distribution of the ingredients may also be achieved by dry blending followed directly by extrusion of the composition onto the electrical conductors making up the heating cable.

The annealing step 248, in certain melt-processing techniques utilizing extrusion, has been found to cure the disruptive effects of extrusion upon the electrical characteristics of the extruded compositions. Annealing step 248 is typically performed at a temperature that is at or above the melt point temperature of the composition for a period of time sufficient to effect the electrical and physical characteristics desired.

The shape of the cable is maintained during the annealing process 248 by the shape-retaining cover applied in step 244 of FIG. 4. In some instances, it may be advantageous to extrude the composition 208 and the shape-retaining covering 210 thereabout simultaneously. When used to prevent or minimize deformation of the extruded composition, the shape-retaining cover should have a melt point temperature that is higher than the annealing temperature. The covering, dependent upon the particular heating cable being made, may be temporary or permanent in nature. If it is permanent, such as, for example, an extruded jacket barrier or conductor, it should be penetrable by the ionizing radiation applied in step 250 so that the composition enclosed within the covering can be cross-linked. If the covering is temporary and provides no function other than shape retainment and is intended to be removed after annealing, then, in addition to having a melt point temperature higher than the annealing temperature, it may or may not be penetrable by radiation, depending upon whether it is to be removed 1) after annealing step 248 and before step irradiation 250 or 2) after annealing step 260. Dependent upon the materials used for the covering, the covering may also be cross-linked, along with the composition, by the irradiation applied in step 250.

Following the cross-linking in step 250, the composition is once again annealed at a temperature at or above its melt point temperature in step 260.

Although not shown in FIG. 4, it is to be understood that cooling the composition of the invention from the higher annealing temperatures to a lower temperature is included in the process of making heating devices. It is preferred that the composition be cooled at least to a temperature sufficient to provide suitable handling characteristics subsequent to annealing step 248. However, certain types of heating devices may be made in a continuous manner without substantial cooling after annealing step 248. Obviously, all compositions of the invention are cooled to ambient temperature after the final annealing step 260.

EXAMPLES

A first heating cable, Sample A, comprises a composition made in accordance with the method described in U.S. Pat. No. 4,200,973 and shown schematically in FIG. 4. A second heating cable, Sample B, comprises a composition made in accordance with the method of the present invention as illustrated in FIG. 2. The ingredients and relative proportions thereof for the Sample A and Sample B semi-conductive compositions are given in Table I below.

TABLE I

INGREDIENTS FOR SAMPLE A AND SAMPLE B

| Ingredients | SAMPLE A Wt % | SAMPLE B Wt % |
|---|---|---|
| High-density polyethylene (Union Carbide DGDJ 3364) | — | 44.5 |
| Low-density polyethylene (Northern Petrochemical NPE-510) | 50.8 | — |
| Ethylene-vinyl acetate (Du Pont Elvax-460) | 12.7 | 19.0 |
| Carbon black (Cabot Vulcan XC-72) | 17.5 | 17.5 |
| Zinc oxide (Harwick Pasco 558) | 19.0 | 19.0 |

The ingredients for the semi-conductive compositions of heating cable Samples A and B were mixed with a Banbury mixer according to normal polymer mixing techniques. The heating cables were extruded with an extruder having a 2½ inch diameter barrel and a length over diameter ratio of 24 to 1.

Both heating cables were produced by extruding the conductive materials onto and between two parallel 16 AWG nickel-plated conductors. Generally accepted polyethylene extrusion techniques were used. The material between the conductors was approximately 0.08 inch thick and the conductors were spaced approximately 0.29 inch apart. In areas of the heating cables where the conductors were not interconnected by the web of semi-conductive material, the conductors were coated with a layer of the semi-conductive material which was about 0.01 inch thick.

A 0.01 inch thick shape-retaining jacket of polyurethane was extruded onto the semi-conductive core of the Sample A heater using the same extruder as used for extruding the core. The Sample A heater was then annealed at 155° C. for a time sufficient to reduce its room temperature resistance to 17 ohms per foot.

Both heater samples were exposed to about 30 megarads of electron-beam generated ionizing radiation then post-irradiation annealed for approximately two hours at 150° C.

The electrical resistance characteristics of the Sample A and Sample B heaters were measured after each of several stages of their respective processes to determine the effects of the various process steps on the electrical properties of the heaters. The temperature versus electrical resistance relations at each of these stages were determined by measuring the resistance of the heaters over a temperature range of from about 25° C. to about 170° C. This was done by placing a one foot specimen of each heater sample in an oven and increasing the oven temperature in increments of about 15° C. to 30° C. At each incremental temperature step, the specimens were allowed to come to temperature equilibrium by subjecting them to a constant temperature for about 20 minutes before measuring their resistances.

Resistances were measured by means of leads connected to the specimens and routed to the outside of the oven through a hole in the side of the oven. A Fluke digital multimeter, Model 8012A, was used to measure resistances below $2\times10^7$ ohms. For resistances above $2\times10^7$ ohms, a General Radio megohm bridge, Model 1644A was used.

Figure 6:
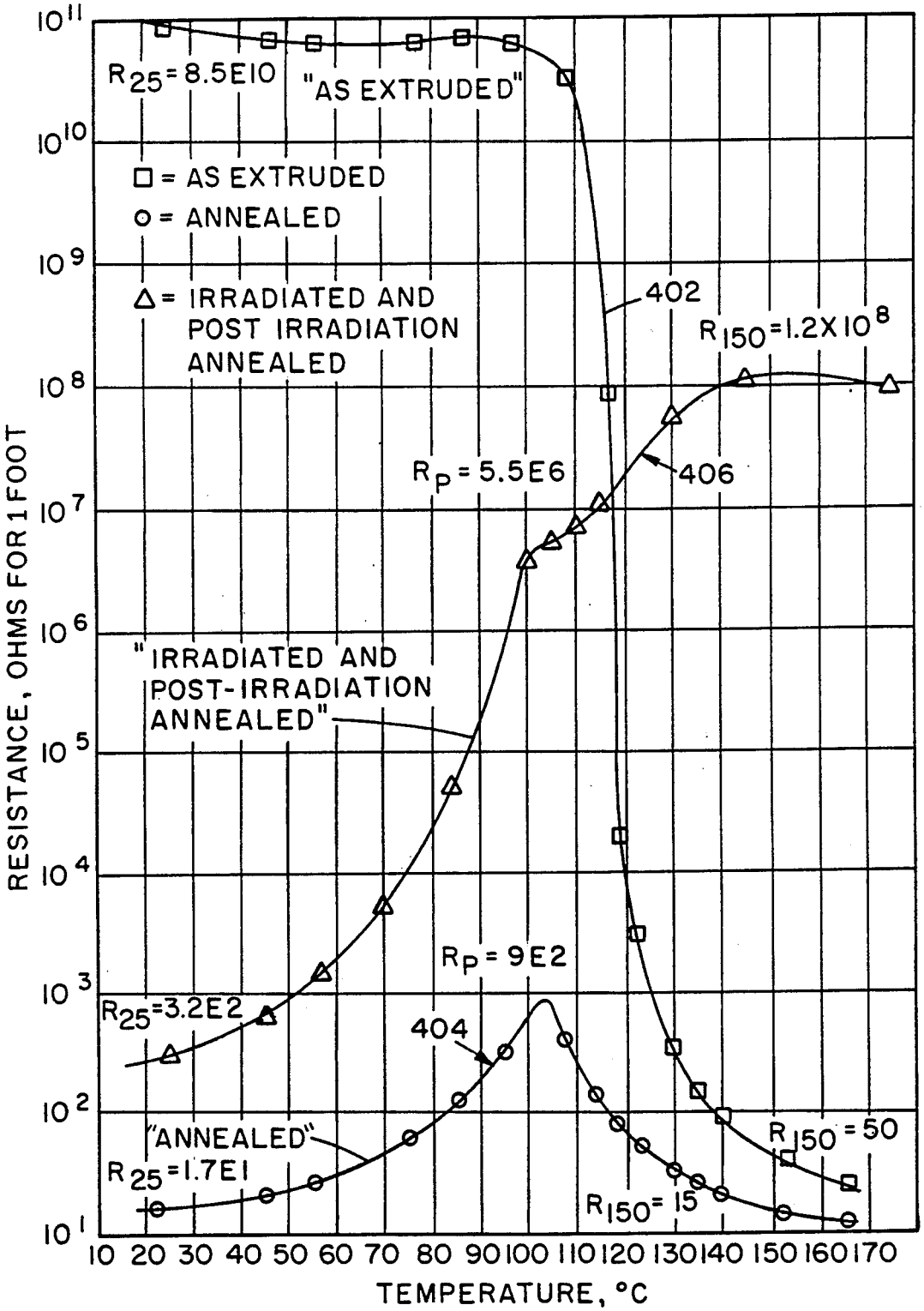
(PRIOR ART) FIG.6
FIG. 6 is a graph of the electrical characteristics of a self-regulating positive temperature coefficient material made in accordance with the method shown in FIG. 4.

Plots of the temperature versus resistance for the two heater samples at various process stages are shown in FIGS. 5 and 6.

FIG. 5 shows the temperature-resistance relations for the Sample B heater over a temperature range of from about 25° C. to about 170° C. A curve labelled 302 shows how the resistance of the Sample B heater varies as a function of temperature after the extrusion step 140 shown in FIG. 2. Similarly, a curve labelled 304 shows the dependence of the Sample B heater's resistance on temperature after all three processing steps, 140, 150 and 160 of FIG. 2 have been completed.

FIG. 6 shows the temperature-resistance relations for the Sample A heater over a temperature range of from about 25° C. to about 170° C. A curve labelled 402 shows how the resistance of the Sample A heater varies as a function of temperature after the extrusion step 240 shown in FIG. 4. A curve labelled 404 shows the dependence of the Sample A heater's resistance on temperature after the first annealing step 248 has bee performed. The resistance characteristics of the Sample A heater after all the processing steps, 240, 244, 248, 250 and 260 of FIG. 4 have been completed is shown as curve 406.

Previous studies of the electrical resistance versus temperature relations of semi-conductive polymeric compositions containing varying amounts of dispersed electrically conductive carbon black particles have resulted in derived terminology that is useful in characterizing the compositions and comparing different compositions. Generally, the type and make-up of the polymeric composition; the nature, physical size and amount of electrically conductive particles; and the method by which they are dispersed in the polymeric matrix determines the value of these derived terms. Some of the more useful derived terms and their definitions are as follows.

$R_{25}$=Resistance of one foot of heater at 25° C. The value of $R_{25}$ may be related to the power output of a self-regulating heater. Depending on the polymeric matrix used, the service voltage of the heater, and the desired power output, a value of $R_{25}$ on the order of about 200 ohms to about 20,000 ohms is useful for making a heater operating at a service voltage of 110 volts to 280 volts.

$R_p$=Peak resistance for one foot of heater. $R_p$ is the resistance reached by the heater near the crystalline melting point of the polymer. At $R_p$, the rate at which the resistance increases as a function of the rate of increase of the temperature becomes substantially less than just prior to the melting point. In general, the higher the value of $R_p$, the greater the ability of the heater to limit current.

$Log_{10} R_p/R_{25}$=Resistivity ratio. The resistivity ratio is a measure of the magnitude of the resistance increase of the composition with temperature. The higher the value of the resistivity ratio, the greater the heater's ability to limit current. A relatively high resistivity ratio is desirable to adequately limit current and prevent a non-crosslinked composition from heating itself to a temperature which allows it to pass through its crystalline melting point. If the composition is allowed to pass the crystalline melting point, the resistance of the composition is reduced and the power output is increased, thus entering a mode where the temperature continues to increase until the composition destroys itself. Crosslinked compositions often exhibit further increases in resistance after $R_p$. Therefore, lower resistivity ratios may be adequate for many applications utilizing crosslinked compositions.

$R_{150}$=Resistance at 150° C. for one foot of heater. The value of $R_{150}$ is a measure of the heater's ability to prevent accelerated power output if the heater is heated above the crystalline melting point of the primary polymer in the conductive composition.

The values of $R_{25}$, $R_p$, $Log_{10} R_p/R_{25}$ and $R_{150}$ for the Sample A and Sample B heaters at various stages of their processing are indicated on FIGS. 5 and 6. Additionally, these values are summarized in the following Table II.

TABLE II

SUMMARY OF SAMPLE A AND SAMPLE B DERIVED TERMS (All resistance values in ohms)

| Property | SAMPLE | After Extrusion | After Annealing | After Irradiation and Post-Irradiation Annealing |
|---|---|---|---|---|
| $R_{25}$ (Ohms/foot) | A | $8.5 \times 10^{10}$ | 17 | 320 |
| (Resistance @ 25° C.) | B | 110 | NA | 1200 |
| $R_p$ (Ohms/foot) | A | NA | 900 | $5.5 \times 10^6$ |
| (Peak Resistance) | B | $6.0 \times 10^5$ | NA | $9.5 \times 10^{10}$ |
| Log $R_pR_{25}$ | A | NA | 1.7 | 4.2 |
| (Resistivity Ratio) | B | 3.7 | NA | 7.9 |
| $R_{150}$ (Ohms/foot) | A | 50 | 15 | $1.2 \times 10^8$ |
| (Resistance @ | B | 60 | NA | $6.0 \times 10^{10}$ |

TABLE II-continued

SUMMARY OF SAMPLE A AND SAMPLE B DERIVED TERMS (All resistance values in ohms)

| Property | SAMPLE | After Extrusion | After Annealing | After Irradiation and Post-Irradiation Annealing |
|---|---|---|---|---|
| 150° C.) | | | | |

The temperature-resistance relations for the Sample B and Sample A heaters "as extruded" is shown in curves 302 (FIG. 5) and 402 (FIG. 6), respectively. The data values comprising these curves were obtained from the Sample B and Sample A heaters after they were extruded, as represented by steps 240 (FIG. 4) and 140 (FIG. 2), respectively. Included on these curves are the electrical resistance of both heaters at room temperature, $R_{25}$. The Sample A heater had a typical $R_{25}$ resistance of approximately $8.5 \times 10^{10}$ ohms for one foot. The Sample B heater had a surprisingly low $R_{25}$ resistance of approximately 110 ohms for one foot. Sample A did not exhibit a meaningful peak resistance, $R_p$, while Sample B had a peak resistance, $R_p$, of about $6.0 \times 10^5$ ohms and a resistivity ratio, $Log_{10} R_p/R_{25}$, of approximately 3.7. The resistances at 150° C., $R_{150}$, for Sample A and Sample B were approximately 50 ohms/foot and 60 ohms/foot, respectively.

A comparison of the resistance versus temperature trends for the Sample A and B heaters after the extrusion step shows that the Sample A heater possesses a very high $R_{25}$ and a very low $R_{150}$, thus exhibiting a "negative" temperature coefficient of resistance in the "as extruded" state. Conversely, the Sample B heater has an attractively low $R_{25}$ and a low $R_{150}$, thus exhibiting a positive temperature coefficient of resistance characteristic in the "as extruded" state. It is because of the very high $R_{25}$ of the Sample A heater that the process for making this heater (see FIG. 4) includes the pre-crosslinking annealing step 248.

As shown by curve 404 of FIG. 6, the pre-crosslinking annealing step 248 significantly reduces the room temperature resistance $R_{25}$ of the Sample A heater from $8.5 \times 10^{10}$ ohms/foot to about 17 ohms/foot. The annealing step 248 also significantly changes the shape of the temperature-resistance relation of Sample A (curve 404) so that it exhibits a meaningful peak resistance, $R_p$, of 900 ohms/foot and a resistivity ratio, $Log_{10} R_p/R_{25}$, of 1.7. Annealing also alters the value of $R_{150}$ of the Sample A heater from 50 ohms/foot to 15 ohms/foot.

The subsequent irradiation step 250 and post-irradiation annealing step 260 raise the room temperature resistance, $R_{25}$, somewhat and significantly raise the resistance at 150° C., $R_{150}$, of the Sample A heater, thus creating a positive temperature coefficient material which is useful for a self-regulating heater. Specifically, the Sample A room temperature resistance, $R_{25}$, is increased from 17 ohms/foot to 320 ohms/foot; the peak resistance, $R_p$, is increased from 900 ohms/foot to $5.5 \times 10^6$ ohms/foot; the resistivity ratio, $Log_{10} R_p/R_{25}$, is increased from 1.7 to 4.2; and the resistance at 150° C. is increased from 15 ohms/foot to $1.2 \times 10^8$ ohms/foot.

The effect of the irradiation step 150 and post-irradiation annealing step 160 further improves the positive temperature coefficient of the "as extruded" Sample B material. Specifically, the Sample B room temperature resistance, $R_{25}$, is increased from 110 ohms/foot to 1200 ohms/foot; the peak resistance, $R_p$, is increased from $6.0\times10^5$ ohms/foot to $9.5\times10^{10}$ ohms/foot; the resistivity ratio, $Log_{10} R_p/R_{25}$, is increased from 3.7 to 7.9; and the resistance at 150° C. is increased from 60 ohms/foot to $6.0\times10^{10}$ ohms/foot.

As can be seen from Table II, the Sample B heater made by the method of the present invention, see FIG. 2, has resistance and current-limiting capabilities comparable to or better than those of the Sample A heater made using the method of FIG. 4.

The system and processes described herein were developed primarily for use in self-temperature-regulating heating devices. However, the invention may also be useful for devices and applications. While the above description comprises a preferred embodiment of the invention as applied to self-temperature-regulating heating devices, there are other applications which will be obvious to those skilled in the art.

The invention may be embodied in other specific forms without departing from its spirit or essential characteristics. The described embodiments are to be considered in all respects only a illustrative and not restrictive. The scope of the invention is, therefore, indicated by the appended claims rather than by the foregoing description. All changes which come within the meaning and range of equivalency of the claims are to be embraced within their scope.

We claim:

1. In a method of forming a self-regulating conductive article comprising at least two spaced-apart electrical conductors electrically interconnected by means of an extruded, cross-linked, electrically semi-conductive composition having a positive temperature coefficient of electrical resistance, said composition containing at least one polymeric component therein to provide sufficient crystallinity to promote the self-regulating conductive characteristics thereof and containing an amount of electrically conductive particles dispersed therein that is controlled within the range of 15 percent to 20 percent by weight to the total weight of the composition, said method comprising the steps of:

forming said cross-linkable, electrically semiconductive composition as to cover said spaced-apart electrical conductors defining a formed composition outer surface in such a manner that said composition electrically interconnects said spaced apart conductors and has a positive temperature coefficient of electrical resistance;

irradiating said formed composition outer surface to cross-link said polymeric component therein, and;

annealing said cross-linked semi-conductive composition at an annealing temperature for an annealing time period sufficient to promote the electrical characteristics desired.

2. The method of claim 1 wherein said step of forming the composition comprises the step of extruding the composition about the conductors.

3. The method of claim 1 wherein said step of annealing comprises:

raising the temperature of the composition to an annealing temperature in the range of from approximately 140° C. to approximately 250° C.; and holding the composition at said annealing temperature for an annealing time period ranging from about a few minutes to about 48 hours.

4. The method of claim 1 wherein said step of irradiating comprises exposing the composition outer surface to a radiation dosage in the range of from about 2 megarads to about 40 megarads.

5. The method of claim 1 wherein the irradiation for cross-linking the composition is provided by means of electron radiation.

6. A method of making an electrically semi-conductive composition having a positive temperature coefficient of electrical resistance and adapted for use in a self-regulating electrical heating article, said composition containing at least one polymeric component therein to provide sufficient crystallinity to promote the self-regulating conductive characteristics thereof and containing an amount of electrically conductive particles dispersed therein that is controlled within the range of 15 percent to 20 percent by weight to the total weight of the composition, said method comprising the steps of:

forming the composition into the shape of said electrical heating article, defining a formed composition outer surface, so that said shaped article has a positive temperature coefficient of electrical resistance;

irradiating said formed composition outer surface to cross-link said polymeric component therein, and;

annealing said cross-linked composition at an annealing temperature for an annealing time period sufficient to promote the electrical characteristics desired.

7. A self-regulating heating cable comprising:

at least two spaced apart electrical conductors, and;

a melt processable, radiation cross-linkable, electrically semi-conductive composition having a positive temperature coefficient of electrical resistance and formed about said electrical conductors defining a formed composition outer surface so that the composition electrically inter-connects said conductors, said composition comprising at least one polymeric component therein to provide sufficient crystallinity to promote the self-regulating conductive characteristics thereof, and further comprising an amount of electrically conductive particles dispersed throughout the composition, wherein the amount of said particles is controlled within the range of about 15 percent to about 20 percent by weight of the total weight of the composition, said composition, after forming, having a first range of electrical resistance which vary with the temperature of the composition, said composition outer surface, after being irradiated to cross-link said polymeric components and then being subsequently annealed at an annealing temperature for an annealing time period to change the electrical characteristics of the composition, having a second range of electrical resistances which vary with the temperature of the extruded, cross-linked and annealed composition, wherein said second range is greater than said first range.

8. A self-regulating conductive article comprising:

an extruded, cross-linked, electrically semi-conductive composition having a positive temperature coefficient of electrical resistance, said composition containing at least one polymeric component therein to provide sufficient crystallinity to promote the self-regulating conductive characteristics thereof and containing an amount of electrically conductive particles dispersed therein to promote the positive temperature coefficient characteristic of the composition, the amount of said particles being controlled within the range of 15 percent to 20 percent by weight to the total weight of the composition;

at least two elongate spaced-apart electrical conductors substantially parallel with a longitudinal axis of said article and electrically interconnected by means of the extruded, cross-linked, electrically semi-conductive composition;

a directly irradiated, and annealed, extruded composition outer surface.

9. A self-regulating electrical heating article comprising:

an electrically semi-conductive composition, formed into the shape of the electrical heating article to define a formed composition directly irradiated and annealed outer surface, having a positive temperature coefficient of electrical resistance and adapted for use in the self-regulating electrical heating article, said composition containing at least one polymeric component therein to provide sufficient crystallinity to promote the self-regulating conductive characteristics thereof and containing an amount of electrically conductive particles dispersed therein to promote the positive temperature coefficient characteristic of the composition, the amount of said particles being controlled within the range of 15 percent to 20 percent by weight to the total weight of the composition;

at least two elongate spaced-apart electrical conductors, substantially parallel with a longitudinal axis of said article, impregnated within the electrically semi-conductive composition of the electrical heating article, for delivering electrical energy thereto.

* * * * *